United States Patent [19]

Harwood et al.

[11] Patent Number: 4,894,987

[45] Date of Patent: Jan. 23, 1990

[54] STAMP FORMED MUFFLER AND CATALYTIC CONVERTER ASSEMBLY

[75] Inventors: Jon W. Harwood; Michael Clegg; Bruno A. Rosa, all of Toledo, Ohio

[73] Assignee: AP Parts Manufacturing Company, Toledo, Ohio

[21] Appl. No.: 234,261

[22] Filed: Aug. 19, 1988

[51] Int. Cl.[4] ..... F01N 3/20

[52] U.S. Cl. ..... 60/299; 181/282; 422/180

[58] Field of Search ..... 60/299; 422/180, 179; 181/255, 266, 269, 272, 282; 55/DIG. 30, DIG. 21, 276

[56] References Cited

U.S. PATENT DOCUMENTS

| | | |
|---|---|---|
| 705,357 | 7/1902 | Keating . |
| 1,110,040 | 9/1914 | Chatain . |
| 2,484,827 | 10/1949 | Harley . |
| 2,658,580 | 11/1953 | Trembley . |
| 2,860,722 | 11/1958 | Gerstung . |
| 2,943,695 | 7/1960 | Jeffords . |
| 3,061,416 | 10/1962 | Kazokas . |
| 3,125,182 | 3/1964 | Earley . |
| 3,140,755 | 7/1964 | Tranel . |
| 3,158,222 | 11/1964 | Richmond . |
| 3,176,791 | 4/1965 | Betts et al. . |
| 3,198,284 | 8/1965 | Powers . |
| 3,412,825 | 11/1968 | Hall . |
| 3,556,735 | 1/1971 | Epelman . |
| 3,638,756 | 2/1972 | Thiele . |
| 3,650,354 | 3/1972 | Gordon . |
| 3,709,320 | 1/1973 | Höllerl et al. . |
| 3,827,529 | 8/1974 | Frietzsche et al. . |
| 3,841,841 | 10/1974 | Torosian et al. . |
| 3,852,041 | 12/1974 | Moore et al. . |
| 3,960,509 | 6/1976 | Abriany . |
| 4,032,310 | 6/1977 | Ignoffo . |
| 4,065,276 | 12/1977 | Nakaya et al. . |
| 4,108,274 | 8/1978 | Snyder . |
| 4,124,091 | 11/1978 | Mizusawa . |
| 4,132,286 | 1/1979 | Hasui et al. . |
| 4,134,472 | 1/1979 | Trainor . |
| 4,215,093 | 7/1980 | Yasuda ..... 422/180 |
| 4,361,423 | 11/1982 | Nitz . |
| 4,396,090 | 8/1983 | Wolfhugel . |
| 4,415,059 | 11/1983 | Hayashi . |
| 4,422,519 | 12/1983 | Nomura et al. . |
| 4,456,091 | 6/1984 | Blanchot . |
| 4,523,660 | 6/1985 | Gaddi . |
| 4,579,194 | 4/1986 | Shiki et al. . |
| 4,700,806 | 10/1987 | Harwood . |
| 4,759,423 | 7/1988 | Harwood et al. . |
| 4,760,894 | 8/1988 | Harwood et al. . |
| 4,765,437 | 8/1988 | Harwood et al. . |

FOREIGN PATENT DOCUMENTS

| | | |
|---|---|---|
| 59-55528 | 9/1984 | Japan . |
| 59-43456 | 12/1984 | Japan . |
| 60-111011 | 6/1985 | Japan . |
| 61-14565 | 5/1986 | Japan . |
| 61-108821 | 5/1986 | Japan . |
| 632013 | 1/1950 | United Kingdom . |
| 1012463 | 12/1965 | United Kingdom . |
| 2120318 | 11/1983 | United Kingdom . |

*Primary Examiner*—Douglas Hart

*Attorney, Agent, or Firm*—Anthony J. Casella; Gerald E. Hespos

[57] ABSTRACT

A combined catalytic converter and muffler is provided. A catalyst is securely mounted in a canister which in turn is mounted intermediate a pair of formed internal plates. The plates are further formed to define an array of tubes therebetween. The tubes comprise an inlet to the muffler and an outlet from the muffler and communicate with the inlet and outlet of the catalytic converter. Selected tubes may have perforations or other apertures through which exhaust gases may communicate. At least one external shell is mounted to the assembled internal plates. The external shell is formed to define a plurality of chambers which communicate with apertures in the internal plates.

19 Claims, 3 Drawing Sheets

STAMP FORMED MUFFLER AND CATALYTIC CONVERTER ASSEMBLY

BACKGROUND OF THE INVENTION

The exhaust system of an internal combustion engine typically functions to collect the exhaust gases produced by the engine, reduce the noise associated with the exhaust gases to an acceptable level, reduce the levels of certain objectionable pollutants in the exhaust gas and deliver the exhaust gas to an acceptable location for release into the atmosphere. The typical prior art exhaust system for vehicles has comprised a manifold for mounting to the engine and collecting the exhaust gases, a plurality of interconnected pipes, a catalytic converter and at least one muffler. The catalytic converter has comprised a canister having opposed inlet and outlet ends which are connected respectively to pipes of the exhaust system. A catalyst is securely mounted within the canister of the catalytic converter. The catalyst in combination with the heated exhaust gases converts the carbon monoxide, unburned hydrocarbons and nitrous oxides into less objectionable exhaust gases. The catalytic converter becomes operative or "lights-off" after it is heated to a specified temperature by the hot exhaust gases. In view of this lighting-off requirement, the catalytic converter typically is placed as near to the engine as possible to interact with the exhaust gases before any significant cooling takes place. The catalytic converter is known to reach substantially elevated temperatures. As a result, catalytic converters often are provided with heat shields and/or insulation to protect adjacent structures from heat related damage.

The one or more mufflers of the exhaust system function principally to reduce exhaust related noise. The typical prior art exhaust muffler comprises a plurality of tubes which communicate with chambers. In particular, the typical prior art exhaust muffler may comprise at least one tube having perforations, louvers or apertures extending therethrough to permit the exhaust gases to communicate with an expansion chamber. The movement of the exhaust gases through a perforated or louvered tube in communication with an expansion chamber generally attenuates a substantial portion of the exhaust gas noises. In most cases, however, some fairly low frequency noise will remain despite the noise attenuating effects of the perforated or louvered tubes and expansion chamber. These residual low frequency noises often are attenuated by one or more tuning tubes which communicate with the remaining tubes of the muffler and which also communicate with substantially enclosed low frequency resonating chambers. The cross-sectional area and length of the tuning tube and the volume of the associated low frequency resonating chamber are selected in accordance with the specific frequency ranges of the residual low frequency noise to be attenuated.

The typical prior art muffler has comprised a plurality of separate tubular members supported in a parallel array by a plurality of spaced apart transversely disposed baffles. The array of tubes and baffles is mounted within an outer shell of elongated generally tubular configuration having a constant generally circular or elliptical cross section along the length of the outer shell. The dimensions of the various internal components of these prior art mufflers have been largely dictated by the exhaust gas characteristics. These internal dimensional requirements have also partly dictated the external dimensions. However, automotive engineers are also required to fit the muffler in the limited available space on the vehicle. Thus, the overall length and cross-sectional shape of the prior art muffler have been appropriately adjusted within the limits dictated by the internal requirements of the muffler to enable the muffler to fit within the available space on the vehicle. The prior art muffler typically has been merely suspended from the underside of the vehicle at a convenient and acceptable location rearwardly of the engine compartment and spaced from the underside of the vehicle.

The prior art has included attempts to combine some noise attenuating functions into a catalytic converter. For example, U.S. Pat. No. 3,061,416 which issued to Kazokas on Oct. 30, 1962 shows a catalytic muffler with a plurality of different catalysts mounted in generally cylindrical arrays at selected locations throughout the muffler. The acoustical functions of the structure appear to be carried out by arrays of perforations in generally cylindrically mounted tubes. The muffler shown in U.S. Pat. No. 3,061,416 is of generally standard outer shell construction, but with an extremely complex multi-component internal configuration.

Another combined catalytic converter and muffler is shown in U.S. Pat. No. 3,556,735 which issued to Epelman on Jan. 19, 1971. U.S. Pat. No. 3,556,735 includes baffles mounted on rods that extend the entire length of the muffler. Certain of the baffles define chambers within which catalysts are mounted. Another similar structure is shown in U.S. Pat. No. 3,841,841 which issued to Torosian on Oct. 15, 1974.

U.S. Pat. No. 4,626,732 issued to Carboni on Oct. 14, 1986 and shows a combined muffler/catalytic converter having certain stamp formed components. The sound attenuating characteristics of the structure shown in U.S. Pat. No. 4,626,732 are derived from certain stamp formed perforated plates mounted in generally parallel arrays within the structure.

Generally, the above described prior art structures which attempt to combine a catalytic converter with a muffler perform a very limited noise attenuation function by permitting some expansion of exhaust gases through perforated baffles, plates or tubes. The noise attenuation achieved by such structures generally would not be sufficient to meet most new car noise requirements within the United States and many other countries. Thus, if these prior art combined catalytic converters and mufflers could ever be used at all, they would have to be supplemented with a second muffler. Additionally, any attempt to expand the above described and identified prior art catalytic converters/mufflers using the teaching of the prior art would substantially increase the dimensions of those structures. The physical limitations suggested by these prior art structures would make it difficult to physically locate the structure in close proximity to the engine to achieve the desirable quick light-off of the catalyst.

Certain prior art mufflers have been formed partly or entirely from stamp formed components. Until very recently, most prior art stamp formed mufflers have largely performed an exhaust gas expansion function. As a result, these prior art stamp formed mufflers would not adequately attenuate the exhaust gas noises and would often leave residual low frequency noises unattenuated.

Recently, however, substantial improvements to stamp formed exhaust mufflers have been made. In particular, U.S. Pat. No. 4,700,806 and U.S. Pat. No. 4,736,817 issued to Jon Harwood and are assigned to the assignee of the subject application. U.S. Pat. No. 4,700,806 and U.S. Pat. No. 4,736,817 are directed to extremely efficient and effective mufflers that comprise arrays of stamp formed tubes, including tuning tubes, and a plurality of chambers, including expansion chambers and low frequency resonating chambers. Thus, the mufflers shown in U.S. Pat. No. 4,700,806 and in U.S. Pat. No. 4,736,817 perform noise attenuating functions at least as well as, or better than, the typical prior art mufflers, but are formed from many fewer components and can be manufactured and assembled efficiently.

Further improvements in stamp formed mufflers are presented in co-pending applications that are assigned to the assignee of the subject application. In particular, U.S. patent application Ser. No. 061,876, now U.S. Pat. No. 4,760,894 is directed to an "EXHAUST MUFFLER WITH ANGULARLY ALIGNED INLETS AND OUTLETS". U.S. patent application Ser. No. 061,913, now U.S. Pat. No. 4,759,423 is directed to an efficient "TUBE AND CHAMBER CONSTRUCTION FOR AN EXHAUST MUFFLER". U.S. patent application Ser. No. 106,244, now U.S. Pat. No. 4,765,437, is directed to an efficient construction for a "STAMP FORMED MUFFLER WITH MULTIPLE LOW FREQUENCY RESONATING CHAMBERS" which enables plural stamp formed tuning tubes and plural low frequency resonating chambers with a substantially reduced deformation of the stamp formed outer shells. U.S. patent application Ser. No. 146,032, now U.S. Pat. No. 4,821,840, is directed to a "STAMP FORMED MUFFLER WITH CONFORMAL OUTER SHELL" which enables the muffler to efficiently conform to the limited available space on a vehicle rather than constant cross section as in most prior art mufflers. The disclosures of the above identified patents and applications assigned to AP Industries, Inc. are incorporated herein by reference.

Despite the many advantages of the above described stamp formed mufflers and despite the substantial engineering work performed on catalytic converters, there have been no combined mufflers/catalytic converters that have performed both intended functions well and have been widely accepted in the marketplace.

In view of the above, it is an object of the subject invention to provide a combined catalytic converter and muffler.

Another object of the subject invention is to provide an exhaust muffler that securely retains, insulates and protects a catalytic converter.

A further object of the subject invention is to provide a combined catalytic converter and exhaust muffler assembly that adequately tunes and attenuates the noise associated with exhaust gases.

Still another object of the subject invention is to provide a combined catalytic converter and exhaust muffler that can be readily fit into the available space on a vehicle.

Yet another object of the subject invention is to provide a combined catalytic converter and exhaust muffler assembly wherein noise attenuating chambers of the assembly contribute to the heat shielding and insulation of the catalytic converter.

Still an additional object of the subject invention is to provide a combined catalytic converter and exhaust muffler formed substantially from a catalyst and stamp formed components and including stamp formed tubes disposed on opposite sides of the catalytic converter to contribute to heat shielding and insulation.

Another object of the subject invention is to provide an exhaust system which removes pollutants and attenuates noise with a substantial weight reduction over prior art systems.

SUMMARY OF THE INVENTION

The subject invention is directed to a combined catalytic converter and exhaust muffler. The combined assembly comprises at least one catalytic converter formed from known catalyst materials and operative to promote the reaction of various reactants (e.g. carbon monoxides, hydrocarbons, nitrous oxides) and convert selected objectionable gases present in the exhaust gas stream. The catalyst may be securely mounted in a canister having inlet means and outlet means for permitting the exhaust gas to communicate with the catalyst. However, the catalyst need not have its own canister, as explained further below.

The combined catalytic converter and muffler assembly of the subject invention further comprises a pair of stamp formed plates which are configured to receive the catalyst and the associated canister if present. In particular, the plates may be formed to define opposed canister shell halves in which the catalytic converter is receivable. The converter shell in the plate may be formed to comprise at least one supporting structure for maintaining a controlled spaced relationship between the catalytic converter and the walls of the converter shell formed in the plates. The controlled spacing achieved by the support structure may contribute to heat insulation and shielding of the catalytic converter. In embodiments where the catalyst is mounted in a canister, at least one of the plates may be stamp formed to remove the portion thereof that would lie adjacent to the catalytic converter canister. In particular, at least one plate may be provided with a large aperture, the perimeter of which is configured and dimensioned to support a portion of the catalytic converter canister.

The internal plates are further formed to define an array of tubes. The tubes formed in the plates may define at least one inlet to the muffler and at least one outlet from the muffler. The tubes formed in the plates are further disposed to communicate with the catalytic converter. For example, the internal plates may be stamp formed such that an inlet to the catalytic converter substantially coincides with and defines the inlet to the muffler. This construction ensures that the catalyst is in direct communication with the most heated exhaust gases to ensure a quicker light-off. The tubes defined by the forming of the internal plates may be defined by channels formed in one plate and disposed to be in register with channels formed in the other plate. Thus, the opposed registered channels may define the array of tubes. Alternatively, in at least certain areas of the combined structure, a channel in one plate may be disposed in register with a generally planar portion of the opposed plate to define, for example, a substantially semicylindrical tubular structure.

Selected locations on the stamp formed tubes may be provided with perforations, louvers, apertures or the like to enable communication between the tubes and chambers formed thereabout, as explained below. Additionally, the array of tubes may comprise at least one tuning tube in communication with the remaining tubes formed by the plates. Each tuning tube may terminate in an aperture which permits communication to a substantially enclosed low frequency resonating chamber as explained herein. At least one of the tubes formed in the plates may be disposed to lie in proximity to but slightly spaced from the catalytic converter. In certain embodiments, the catalytic converter may be disposed intermediate a plurality of tubes formed in the internal plates. Thus, the one or more tubes disposed in proximity to the catalytic converter may perform both a noise attenuating function within the assembly, and may further perform a heat insulating or shielding function with respect to the catalytic converter. In particular, the presence of the one or more tubes intermediate the catalytic converter and other structures on the vehicle may contribute to the heat shielding required for the catalytic converter, thereby avoiding or reducing the need for additional heat shield structures.

The combined catalytic converter and exhaust muffler assembly further comprises at least one formed external shell. More particularly, the external shell may be formed to define a plurality of chambers which may surround the catalytic converter and/or the tubes formed in the plates. The chambers formed by the external shell may comprise an expansion chamber which communicates with perforations, louvers or apertures defined at selected locations on the tubes formed in the plates. The chambers may further comprise at least one low frequency resonating chamber surrounding one or more apertures defined in a tuning tube formed by the internal plates. A pair of formed external shells may be provided to be disposed on opposed sides of the two plates. The two formed external shells need not be identical nor symmetrical, but rather would be formed to fit in the available space on the vehicle. The external shells may further be formed to define a plurality of ribs which may perform a dual function of reinforcing the assembly and contributing to the heat insulating or shielding requirements of the catalytic converter. For example, ribs in the external shells may help to dissipate stored heat and may prevent contact with portions of the shell closest to the converter.

The combined catalytic converter and muffler may further comprise appropriate insulating or vibration dampening material disposed in proximity to the catalytic converter. For example, heat insulating material may be disposed in at least a portion of the space intermediate the catalytic converter and an external shell or internal plate of the muffler. The combined structure may further comprise one or more additional shells for contributing to the plural functions carried out by the structure. For example, a smaller shell may be disposed intermediate the catalytic converter and the external shell of the muffler to retain insulation material therein. Alternatively, a stamp formed heat shield may be disposed on at least one side of the external shell to ensure adequate separation of the combined structure from heat sensitive components of the vehicle.

DETAILED DESCRIPTION OF THE PREFERRED EMBODIMENT

Figure 1:
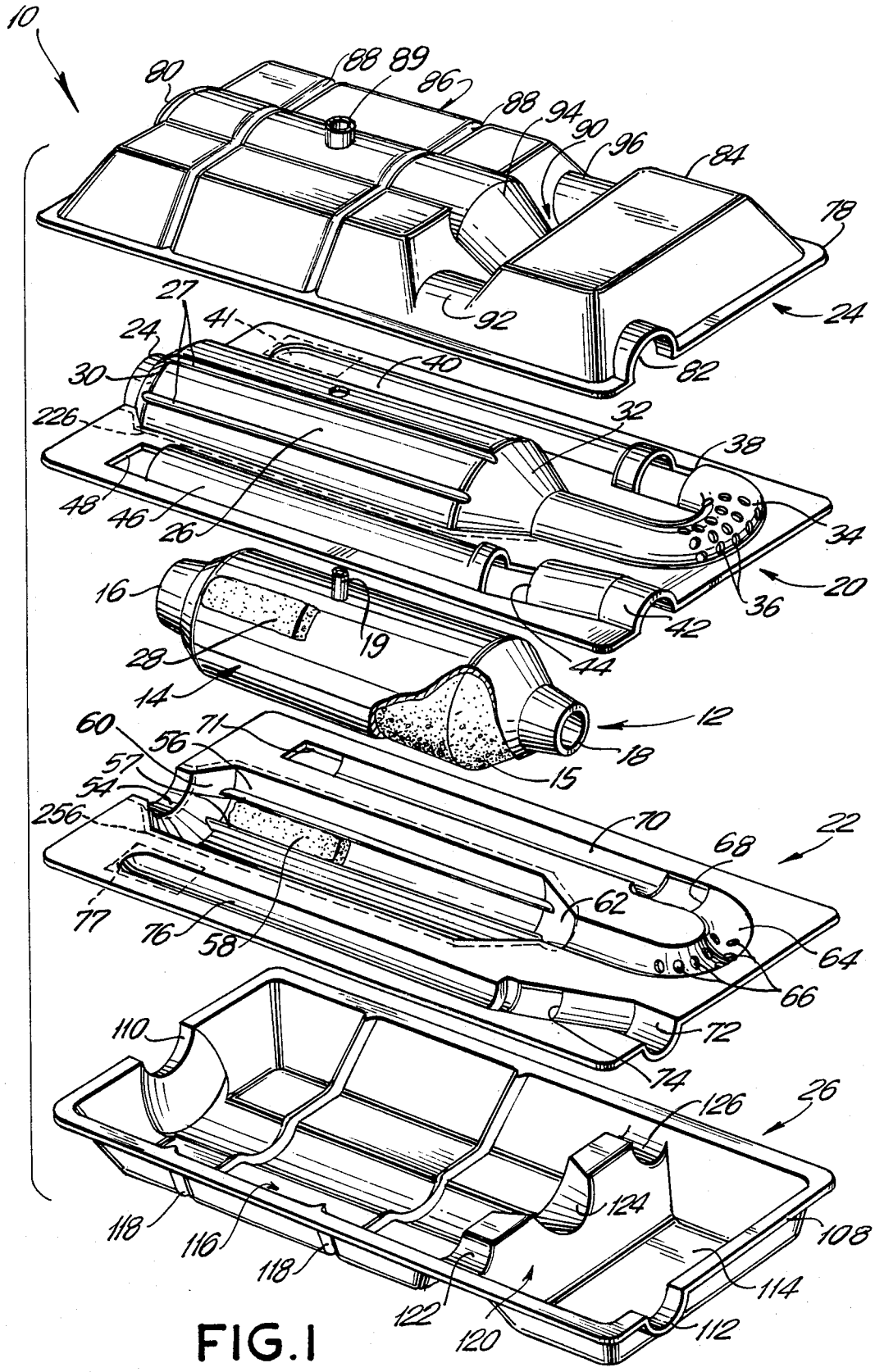
FIG. 1 is an exploded perspective view of the combined catalytic converter and muffler of the subject invention.

The catalytic converter and muffler assembly of the subject invention is identified generally by the numeral 10 in FIGS. 1–4. As shown most clearly in FIG. 1, the catalytic converter and muffler assembly 10 comprises a generally centrally disposed catalytic converter 12 having a canister 14 with a catalyst 15 mounted therein. The canister 14 is provided with opposed inlet and outlet ends 16 and 18 which are connectable to other parts of the exhaust system as explained further below. The catalyst 15 mounted in the canister 14 is of known construction (such as a catalytic material coated on a metal or ceramic substrate or biscuit). The catalyst 15 is operative to react with certain gaseous compounds in the exhaust gas and to convert those compounds to less objectionable forms. The canister 14 may be of any noncylindrical shape depending on the particular construction of the catalyst and the available space on the vehicle. Similarly, the means for providing exhaust gas communication to the catalyst 15 need not be a single inlet and an axially opposed outlet. The particular canister configuration may be selected in accordance with engineering design parameters. In fact, certain desirable embodiments, as described below, may provide a catalyst 15 without its own canister 14. Rather the catalyst 15 may be supported and enclosed within the internal plates which define the tubes of the assembly 10. However, the use of a canister 14 may offer certain manufacturing efficiencies in that an assembled catalytic converter 12 can be easily inserted into proper position within the other formed components of the assembly 10. The catalytic converter 12 depicted in FIGS. 1–4 further comprises a secondary air injection tube 19 which permits a flow of air into the catalyst 15 to promote the reactions in accordance with the specifications for many exhaust systems. Of course, the air injection tube 19 is not structurally required and will not be included on many embodiments of the subject assembly.

The catalytic converter and muffler assembly 10 further comprises first and second internal plates 20 and 22 and first and second external shells 24 and 26. The internal plates 20 and 22 are formed by stamping or other appropriate metal forming processes to define an area for receiving the catalytic converter 12 and to define an array of tubes as explained herein. More particularly, the internal plate 20 comprises an inlet channel 24 of generally semicircular cross section. A converter shell 26 is formed adjacent and in communication with the inlet channel 24. The converter shell 26 is depicted as being of generally semicylindrical configuration to conform to the generally cylindrical canister 14 of the catalytic converter 12. However, as noted above, the catalytic converter 12 can be of noncylindrical configurations, with the converter shell 26 conforming to such configurations. The converter shell is characterized by spaced apart longitudinally extending ribs 27 which may be provided to contribute to the support of the converter 12. The ribs 27 may alternatively be transversely aligned and may be employed to securely retain the catalyst 15 in a selected position in embodiments where a canister 14 is not provided around the catalyst 15. The converter shell 26 preferably is dimensioned larger than the canister 14 of the catalytic converter 12 to permit placement of an insulation or vibration dampening material 28 therebetween, for example, between adjacent ribs 27. The converter shell 26 further comprises tapered inlet and outlet end portions 30 and 32 which reduce down to a diameter to enable the internal plate 20 to closely conform to the inlet and outlet 16 and 18 of the catalytic converter 12. An aperture 33 permits the secondary air injection tube 19 to be passed through the internal plate 20.

The internal plate 20 further comprises a generally arcuate return channel 34 which extends from the reduced diameter portion 32 extending from the outlet end of the converter shell 26. The reduced diameter portion 34 is dimensioned to engage the outlet end 18 of the catalytic converter 12. The return channel 34 extends through an angle of approximately 180° with a smooth sweeping turn. A plurality of perforations 36 are stamp formed into the channel 34 to permit communication of exhaust gases traveling through the channel 34 with the chamber disposed thereabout as explained further below.

The return channel 34 terminates at a cross-flow aperture 38 stamp formed in the internal plate 20. A tuning channel 40 is generally aligned with the return channel 34 and extends from the aperture 38 therein. As explained in the above described related patents and applications, the cross-sectional area and length of the tuning channel 40 are selected in accordance with the frequencies of a fairly narrow range of low frequency sound to be attenuated by the combined catalytic converter and muffler 10. The tuning channel 40 is disposed in slightly spaced relationship to the converter shell 26 and generally parallel thereto. Thus, the tuning channel 40 is disposed intermediate the converter shell 26 and a corresponding peripheral edge of the internal plate 20.

The internal plate 20 further comprises an outlet channel 42 extending between a peripheral location on the internal plate 20 and an aperture 44 stamp formed therein. The aperture 44 is disposed to be in communication with a chamber of the catalytic converter and muffler assembly 10 as explained further below. Thus, exhaust gases flowing through the perforations 36 and through the aperture 38 will travel to the outlet channel 42 by way of the aperture 44.

A second tuning channel 46 extends from the aperture 44 in slightly spaced relationship to the converter shell 26 and generally parallel thereto. Thus, the tuning channel 46 is disposed intermediate the converter shell 26 and a peripheral edge of the internal plate 20. The tuning channel 46 terminates at a tuning aperture 48 which permits communication of exhaust gases to a low frequency resonating chamber of the catalytic converter and muffler assembly 10 as explained herein.

The internal plate 20 is depicted as being of rectangular configuration. However, the specific configuration would be selected to conform to the available space on the vehicle. Although the internal plate 20 is depicted as having a substantially planar peripheral portion, nonplanar configurations can be provided.

The internal plate 22 defines a periphery substantially conforming to the size and shape of the first internal plate 20. Additionally, the second internal plate 22 is provided with an array of channels as explained herein to be placed in register with the above described channels of the first internal plate 20. In particular, the second internal plate 22 is stamped or otherwise formed to define an inlet channel 54 disposed to be in register with the inlet channel 24 of the first internal plate 20, and disposed to communicate with the catalytic converter 12. A converter shell 56 having a plurality of support ribs 57 formed therein extends from the inlet channel 54, and is dimensioned and configured to conform generally to the shape of the catalytic converter 12. As noted above, the support ribs 57 may be of configurations other than those shown in FIG. 1–4 and may be operative to securely retain a catalyst coated biscuit or the like in embodiments where a canister 14 is not provided. An insulating or vibration dampening material 58 is disposed in the converter shell 56 and intermediate the catalytic converter 12 and the internal plate 22. The insulating or vibration dampening material 58 provides heat insulation which protects parts that may be disposed in proximity to the catalytic converter 12. The opposed ends 60 and 62 of the converter shell 56 taper to reduced dimensions to enable the second internal plate 22 to closely engage the opposed inlet and outlet ends 16 and 18 of the catalytic converter 12.

A return channel 64 extends from the tapered outlet end 62 of the converter shell 56. The return channel 64 extends through an angle of about 180°, and is provided with an array of perforations 66 formed therein to permit communication of the exhaust gases traveling through the return channel 64 with an expansion chamber at least partly surrounding the internal plate 22. The return channel 64 terminates at an aperture 68 stamp formed in the internal plate. As will be noted further below, the aperture 68 permits a cross flow of exhaust gases to the outlet of the assembly 10.

A tuning channel 70 extends from the aperture 68 to a tuning aperture 71 stamp formed through the second internal plate 22. The tuning channel 70 is slightly spaced from but generally parallel to the converter shell 56. Thus, as explained above, the tuning channel 70 is disposed intermediate the converter shell 56 and corresponding external portions of the internal plate 22. The tuning channel 70 is disposed and dimensioned to generally conform to the tuning channel 40, and to be placed generally in register therewith. As explained above, the length and cross-sectional area of the tuning tube formed by the channels 40 and 70 are selected in accordance with the characteristics of the sound to be attenuated.

An outlet channel 72 extends between a peripheral location on the second internal plate 22 and an aperture 74 stamp formed therein. Thus, exhaust gases may flow out of the perforations 66 and out of the aperture 68 both in the return tube 64, and into the aperture 74 communicating with the outlet channel 72.

A second tuning channel 76 is in communication with the aperture 74. The second tuning channel 76 is disposed in slightly spaced relationship to the converter shell 56 and is generally parallel thereto. Thus, the tuning channel 76 is disposed intermediate the converter shell 56 and a corresponding peripheral portion of the second internal plate 22.

The channels formed in the first and second internal plates 20 and 22 are disposed to be placed generally in register with one another, and to define an array of exhaust carrying tubes therebetween.

The first external shell 24 includes a peripheral flange 78 which is dimensioned to substantially follow and engage the planar portions of the internal plate 20. The external shell 24 further comprises generally arcuate peripheral portions 80 and 82 to conform to the shape of and engage the inlet channel 24 and the outlet channel 42 respectively of the first internal plate 20.

The stamp forming of the first external shell 24 defines an expansion chamber 84 and a low frequency resonating chamber 86. More particularly, the expansion chamber 84 extends away from the peripheral flange 78 and is disposed and dimensioned to surround and substantially enclose the perforations 36 and the apertures 38 and 44 stamp formed in the first internal plate 20. The uppermost surface of the expansion chamber 84 is depicted as being of a generally planar shape, but could be of any convex or concave configuration to conform to some adjacent structure on the vehicle. Additionally, a nonrectangular plan view configuration of the expansion chamber 84 is selected to enable the expansion chamber 84 to extend into available space on the vehicle, and thereby achieve the proper volume to attenuate the noise associated with the flowing exhaust gases.

The low frequency resonating chamber 86 is disposed to surround the tuning aperture 48. The volume of the low frequency resonating chamber 86 is selected in accordance with the frequency of the low frequency sound to be attenuated by the catalytic converter and muffler assembly 10. The particular shape of the low frequency resonating chamber 86 is determined in part by the available space on the vehicle. Additionally, the low frequency resonating chamber 86 is configured and dimensioned to be spaced from the walls of the converter shell 26, such that the entire volume of the low frequency resonating chamber 86 can communicate with the tuning aperture 48 stamp formed in the first internal plate 20. This spacing also enables the low frequency resonating chamber 86 to function as an insulation and heat shield for the catalytic converter 12.

The expansion chamber 84 and the low frequency resonating chamber 86 are spaced from one another by a crease 90 extending generally transversely across the first external shell 24. The crease 90 is provided with arcuate portions 92, 94 and 96 which are dimensioned and disposed to engage the tuning channel 46, the tapered end portion 32 of the converter shell 26 and the tuning channel 40 respectively, all of which are stamp formed in the first internal plate 20. Portions of the first external shell 24 adjacent the crease 90 may be welded to the first internal plate 20 to prevent vibration related noise. These weldments are shown most clearly in FIG. 2 and are identified generally by the numeral 98. The crease 90 and the expansion chamber 84 disposed in proximity to the arcuate portion 94 of crease 90 further contribute to the heat insulation and shielding required for the catalytic converter 12.

Figure 3:
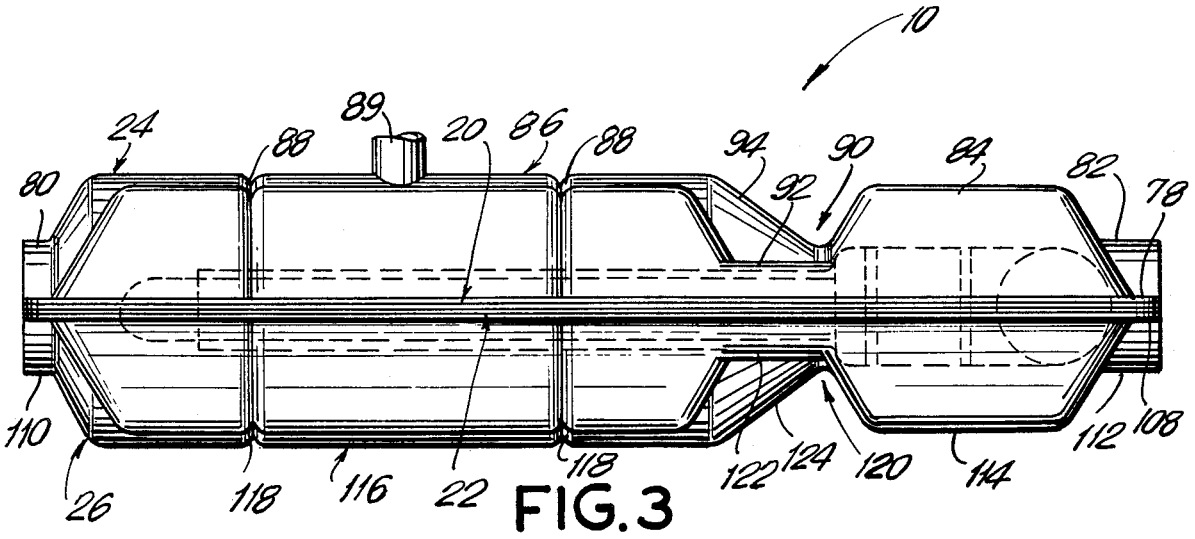
FIG. 3 is a side elevational view of the combined catalytic converter and muffler shown in FIG. 2.

The low frequency resonating chamber 86 further comprises a plurality of transverse support ribs 88 which contribute to the strength of the first external shell 24 and minimize vibration related noise attributable to the flow of exhaust gases therethrough. The ribs 88, as shown most clearly in FIG. 3, are of generally V-shape and are dimensioned such that the lowermost portion of each V-shaped rib is in spaced relationship to the converter shell 26. The portions between adjacent ribs 88 further ensure comparatively large volume channels within the low frequency resonating chamber 86 to ensure that portions of low frequency resonating chamber 86 on opposed sides of the converter shell 26 function as a single chamber. Tube 89 extends from the external shell 24 for communication with the secondary air injection tube 19.

The second external shell 26 is functionally similar to the first external shell 24. However, the first and second external shells 24 and 26 are not required to be mirror images of one another. Rather, the second external shell 26 will be independently configured to conform to the available space sight lines or ground clearance for the vehicle. The external shell 26 includes a generally planar peripheral flange 108 which is configured to be placed in abutting relationship to planar portions of the second internal plate 22. Arcuate peripheral portions 110 and 112 extend out of the plane of the peripheral flange 108 and are disposed and dimensioned to engage the inlet and outlet channels 54 and 72 respectively of the second internal plate 22.

The second external shell is further stamp formed to define an expansion chamber 114 and a low frequency resonating chamber 116 which extend out of the plane of the peripheral flange 108. The expansion chamber 114 is disposed to communicate with the perforations 66 and the apertures 68 and 74 stamp formed in the second internal plate 22. The expansion chambers 84 and 114 of the first and second external shells 24 and 26 will function substantially as a single expansion chamber having tubes passing therethrough. The volume of the combined expansion chamber 84, 114 is selected to attenuate a broad range of the noise generated by the flow of exhaust gases. However, the expansion chambers 84 and 114 need not be the same volume or shape.

The low frequency resonating chamber 116 is disposed to substantially surround the tuning aperture 71 stamp formed in the second internal plate 22. The volume of the low frequency resonating chamber 116 together with the length and cross section of the tuning tube defined by channels 40 and 70 in the internal plates 20 and 22 are selected in accordance with the range of low frequency noise to be attenuated. A plurality of ribs 118 extend transversely across the low frequency resonating chamber 116 to perform the functions described above with respect to the ribs 88 in the first external shell 24. In particular, the ribs 118 will be spaced from the converter shell 56 to ensure that the entire low frequency resonating chamber 116 functions as a single unit.

The expansion chamber 114 is separated from the low frequency resonating chamber 116 by crease 120. The crease 120 is further provided with arcuate portions 122, 124 and 126 which are disposed and dimensioned to engage the tuning channel 76, the tapered portion 62 of converter shell 56 and the tuning channel 70, all of which are stamp formed in the second internal plate 22.

The combined catalytic converter and muffler 10 is assembled by first disposing the catalytic converter 12 intermediate the first and second internal plates 20 and 22. On certain embodiments, the insulation 28, 58 will be sandwiched in between the catalytic converter 12 and the converter shell portions 26 and 56 of the internal plates 20 and 22 respectively. The two internal plates 20 and 22 will then be spot welded to one another or otherwise joined at selected locations to ensure alignment of the respective channels with one another and to securely retain the converter 12 therebetween. Preferably, the welding or joining will securely retain the respective inlet and outlet portions 16 and 18 of the catalytic converter 12 to corresponding portions of the internal plates 20 and 22.

Figure 2:
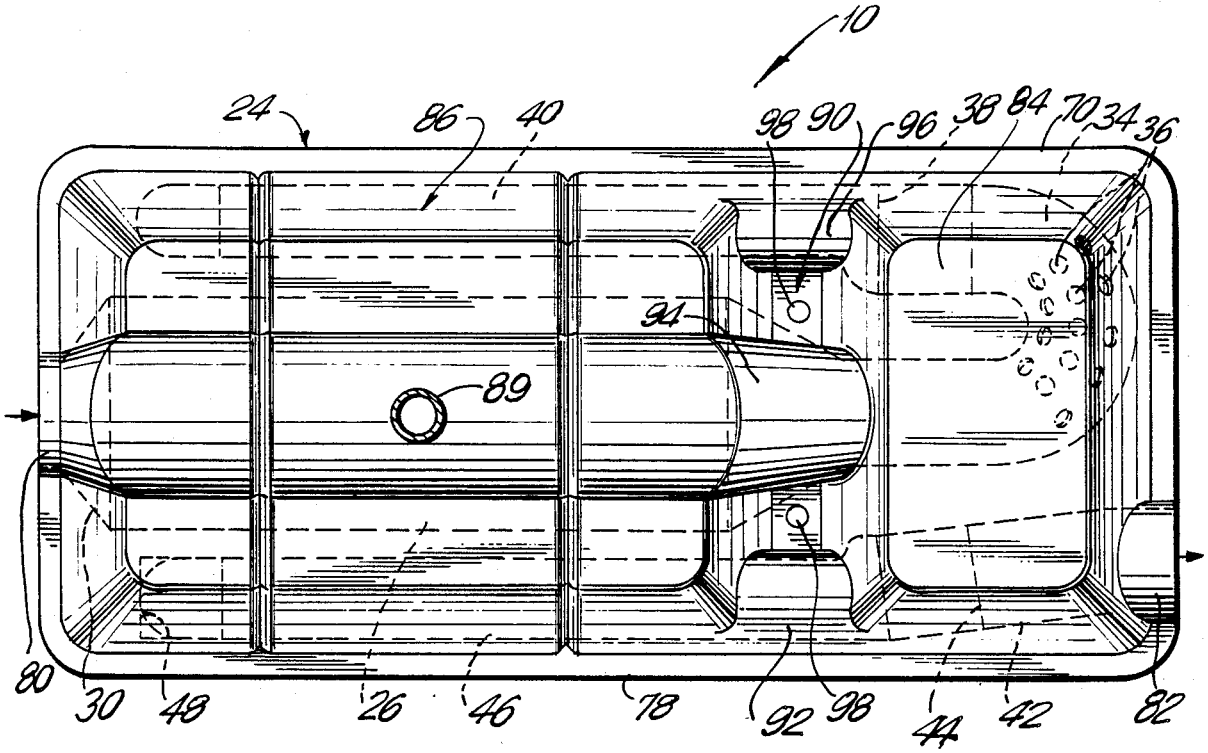
FIG. 2 is a top plan view of the combined catalytic converter and muffler of the subject invention.
Figure 4:
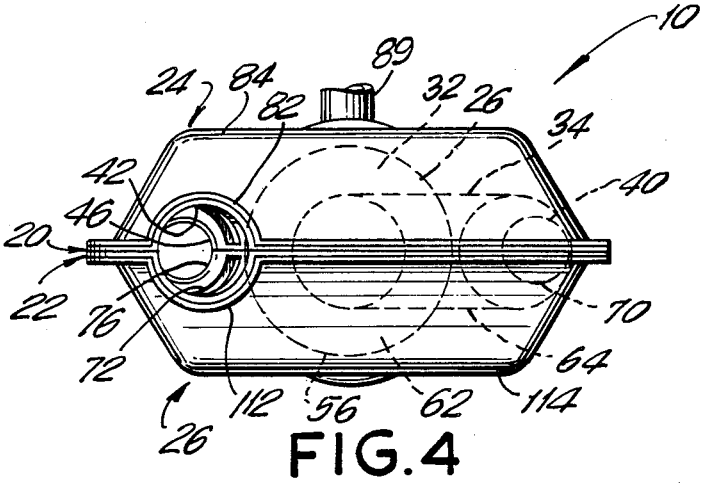
FIG. 4 is an end elevational view of the combined catalytic converter and muffler shown in FIGS. 2 and 3.

The assembled internal plates 20 and 22 with the catalytic converter 12 disposed therebetween are then mounted intermediate the external shells 24 and 26. In the assembled condition, the tuning tubes formed by channels 40 and 70 and by channels 46 and 76 will be disposed intermediate the converter 12 and the aligned peripheral flanges 78 and 108. These assembled components may be spot welded to one another at spaced apart locations around the peripheral flanges 78 and 108 and at locations within creases 90 and 120. The assembly 10 may then be presented to a seam welder or mechanical edge forming apparatus to complete the welding or mechanical connection around the peripheral flanges 78 and 108. The completed assembly is depicted in FIGS. 2–4.

Returning to FIG. 1, alternate embodiments are depicted in phantom lines thereon. For example, in certain embodiments, tuning apertures 41 and 77 may be stamp formed in the respective tuning channels 40 and 76 of the internal plates 20 and 22 respectively. In these embodiments, the external shell may be securely connected, by welding for example, to the converter shells 26 and 56. In this embodiment, therefore, a first low frequency resonating chamber would be defined on one generally longitudinal half of the catalytic converter and muffler assembly 10, while a second low frequency resonating chamber would be defined on the opposed half thereof. The two low frequency resonating chambers defined by this embodiment would be separated from one another by the catalytic converter. Thus, each low frequency resonating chamber would be defined by portions of both the first and second external shells 24 and 26.

Still another alternate embodiment would include a converter aperture depicted by cutout portion 226 and 256, which again are shown in phantom lines. In these embodiments, the catalytic converter would not be enclosed within shells defined by the internal plates. Thus, in these embodiments, the low frequency resonating chambers 86 and 116 could perform a more substantial heat insulating and shielding function than in the previously described embodiments.

In summary, a catalytic converter and muffler assembly is provided. The catalyst is securely mounted in a canister which in turn is mounted intermediate a pair of stamp formed internal plates. The internal plates may be stamp formed to define a shell surrounding the canister of the catalytic converter. The internal plates are further stamp formed to define an array of channels, such that the channels may be disposed in register with one another to define an array of tubes for the catalytic converter and muffler assembly. Selected tubes in the array may be provided with perforations, louvers or apertures to permit communication to chambers for attenuating noise. Selected tubes may define tuning tubes having lengths and cross sections selected to attenuate a particular narrow range of low frequency noise. External shells are stamp formed to define a plurality of chambers and are disposed around and secured to the internal plates. The chambers of the external shell may define at least one expansion chamber and at least one low frequency resonating chamber communicating with the at least one tubing tube.

While the invention has been described with respect to a preferred embodiment, it is understood that various changes can be made without departing from the scope of the invention as defined by the appended claims.

What is claimed is:

1. A catalytic converter and exhaust muffler assembly having an inlet and an outlet for connection to pipes of an exhaust system, said assembly comprising:

a catalytic converter;

first and second internal plates formed to engage said catalytic converter and to define channels disposed to define an array of tubes between said plates, said array of tubes being in communication with the catalytic converter and with the inlet and outlet of the assembly, selected portions of said channels being provided with perforations extending therethrough; and at least one external shell secured to and surrounding at least portions of said internal plates, said external shell being stamp formed to define at least one expansion chamber surrounding and enclosing the perforations in the channels.

2. An assembly as in claim 1 comprising a pair of external shells secured to and surrounding said internal plates.

3. An assembly as in claim 1 wherein said array of tubes further comprises at least one tuning tube having a tuning aperture extending through at least one of said internal plates, and wherein said external shell is stamp formed to further define at least one low frequency resonating chamber surrounding the tuning aperture.

4. An assembly as in claim 3 wherein said external shell comprises a peripheral flange, and wherein said tuning tube is disposed intermediate said peripheral flange and said catalytic converter to contribute to heat insulation of the catalytic converter.

5. An assembly as in claim 4 comprising a pair of tuning tubes and a pair of external shells which are formed to define a pair of low frequency resonating chambers, each of said tuning tubes being disposed intermediate said catalytic converter and portions of the peripheral flange of said external shell.

6. An assembly as in claim 5 wherein said catalytic converter is generally elongated, and wherein said tuning tubes extend generally parallel to said catalytic converter.

7. An assembly as in claim 6 wherein said catalytic converter is disposed generally centrally intermediate said tuning tubes.

8. An assembly as in claim 1 further comprising insulation material intermediate said catalytic converter and said external shell.

9. An assembly as in claim 1 wherein said external shell is spaced from said catalytic converter.

10. An assembly as in claim 1 wherein at least one said chamber defined by said external shell substantially surrounds said catalytic converter and contributes to the insulation thereof.

11. An assembly as in claim 1 wherein the internal plates are stamp formed to define a converter shell for securely engaging the catalytic converter therebetween.

12. An assembly as in claim 11 wherein the converter shells stamp formed in said internal plates comprise a plurality of ribs for supporting the catalytic converter.

13. An assembly as in claim 11 wherein the catalytic converter comprises a catalyst disposed in direct abutting engagement with the converter shell formed in the internal plates.

14. An assembly as in claim 1 wherein the catalytic converter comprises a catalyst and a catalyst canister having inlet and outlet means for gas communication with the tubes defined by said formed internal plates.

15. An assembly as in claim 1 wherein said external shell is stamp formed to define a crease therein, said crease being substantially adjacent a portion of said external shell surrounding said catalytic converter, whereby said crease contributes to heat shielding of said catalytic converter.

16. An assembly as in claim 1 wherein said catalytic converter is substantially adjacent the inlet to the assembly.

17. A catalytic converter and muffler assembly having an inlet and an outlet for connection to pipes of an exhaust system, said assembly comprising:

a catalytic converter having an inlet and an opposed outlet and a catalyst mounted therebetween, the inlet to the catalytic converter being in communication with the inlet to the assembly;

a pair of formed internal plates disposed generally in face-to-face relationship with one another and substantially surrounding and engaging said catalytic converter, said internal plates being formed to define an array of channels therein, said channels being disposed in generally opposed relationship to define a plurality of tubes, one said tube being mounted to and in communication with the outlet from said catalytic converter, said tubes further comprising an outlet from said assembly and a pair of tuning tubes disposed respectively on opposite sides of said catalytic converter, said tuning tubes being in communication with the remaining tubes in said array and terminating respectively at tuning apertures; and a pair of external shells secured to and surrounding the internal plates, said external shells being stamp formed to define a plurality of chambers including first and second low frequency resonating chambers surrounding and enclosing the tuning apertures of said tuning tubes, said chambers of said external shells further surrounding said catalytic converter and contributing to the heat insulation thereof.

18. An assembly as in claim 17 further comprising insulating material disposed intermediate said catalytic converter and said internal plates.

19. An assembly as in claim 17 wherein said selected tubes in said array intermediate said catalytic converter and the outlet from said assembly are provided with perforations extending therethrough, at least one chamber defined by said external shell substantially surrounding said perforations to define an expansion chamber for attenuating noise.

* * * * *